US012146286B1

(12) United States Patent
Reardon et al.

(10) Patent No.: US 12,146,286 B1
(45) Date of Patent: Nov. 19, 2024

(54) SELECTIVELY FRICTIONALLY ENGAGED HOLE COVER

(71) Applicant: Clover Equipment, LLC, Anaheim, CA (US)

(72) Inventors: Mike Reardon, Yorba Linda, CA (US); Kevin Reardon, Anaheim Hills, CA (US)

(73) Assignee: Clover Equipment, LLC, Anaheim, CA (US)

( * ) Notice: Subject to any disclaimer, the term of this patent is extended or adjusted under 35 U.S.C. 154(b) by 0 days.

(21) Appl. No.: 18/421,384

(22) Filed: Jan. 24, 2024

Related U.S. Application Data

(63) Continuation of application No. 18/487,680, filed on Oct. 16, 2023.

(51) Int. Cl.
*E02D 29/14* (2006.01)

(52) U.S. Cl.
CPC ..... *E02D 29/1427* (2013.01)

(58) Field of Classification Search
CPC ..... E02D 29/1427; E01D 29/149
See application file for complete search history.

(56) References Cited

U.S. PATENT DOCUMENTS 822,562 A 6/1906 Tucker
2,388,561 A * 11/1945 Morris ..... E02D 29/1427 292/6
2,482,367 A 9/1949 Ravers
2,810,401 A 10/1957 Stansbury
3,030,903 A 4/1962 Morris
4,285,368 A 8/1981 Terrill et al.
4,461,597 A * 7/1984 Laurin ..... E02D 29/1427 292/DIG. 72

(Continued)

FOREIGN PATENT DOCUMENTS

KR 20220063671 A * 5/2022

OTHER PUBLICATIONS

U.S. Appl. No. 17/357,820, filed Jun. 24, 2021, U.S. Pat. No. 11,365,524.

(Continued)

*Primary Examiner* — Thomas B Will
*Assistant Examiner* — Katherine J Chu
(74) *Attorney, Agent, or Firm* — UltimatEdge IP Law Group, P.C.; Dean G. Stathakis

(57) ABSTRACT

A selectively frictionally engaged hole cover for a bore hole cored from a paved surface that includes a cover plate configured to cover the bore hole and support vehicular traffic. An engagement mechanism is attached to the cover plate and extends down into the bore hole. The engagement mechanism is configured to be actuated by a user torque input that causes an engagement plate selectively shiftable relative to the cover plate to thereby shift an engagement member along a sloped wall and thus radially outwardly or inwardly, causing the engagement mechanism to selectively engage or disengage the wall of the bore hole. When the engagement member is in frictional contact with the hole, unintentional extraction of the engagement mechanism is prevented. The selectively frictionally engaged hole cover effectively provides a temporary cover for a bore hole in a road, parking lot, or other paved surface.

23 Claims, 8 Drawing Sheets

(56) References Cited

U.S. PATENT DOCUMENTS

| | | | | |
|---|---|---|---|---|
| 4,763,449 | A * | 8/1988 | Vigneron | E02D 29/149 220/301 |
| 5,076,025 | A | 12/1991 | Reeble | |
| 5,240,346 | A * | 8/1993 | Yin | E02D 29/149 404/25 |
| 5,382,113 | A * | 1/1995 | Chilton | E02D 29/12 404/25 |
| 5,881,420 | A | 3/1999 | Bruckelmyer | |
| 5,987,824 | A | 11/1999 | Fuller | |
| 6,029,709 | A | 2/2000 | Burgess | |
| 6,488,440 | B1 | 12/2002 | Hill | |
| 6,739,796 | B1 | 5/2004 | Del Nero et al. | |
| 8,661,758 | B2 | 3/2014 | Longhenry | |
| 8,689,488 | B2 | 4/2014 | Rodrigue et al. | |
| 9,340,988 | B2 | 5/2016 | Lyristakis | |
| 9,700,943 | B2 | 7/2017 | Vicario Burgos et al. | |
| 10,480,679 | B2 * | 11/2019 | Stadler | E05C 1/004 |
| 10,640,996 | B2 | 5/2020 | Hartman | |
| 10,935,159 | B2 * | 3/2021 | Stadler | F16K 35/10 |
| 11,365,524 | B1 | 6/2022 | Reardon et al. | |
| 2012/0036787 | A1 | 2/2012 | Rodrigue et al. | |
| 2014/0252292 | A1 | 9/2014 | Clarke et al. | |
| 2014/0334876 | A1 | 11/2014 | Reynolds et al. | |
| 2015/0020458 | A1 | 1/2015 | Sinclair | |
| 2015/0204046 | A1 | 7/2015 | Taylor | |
| 2016/0053458 | A1 | 2/2016 | Stadler | |
| 2016/0160532 | A1 | 6/2016 | Patino et al. | |
| 2017/0073921 | A1 | 3/2017 | Mitola et al. | |
| 2017/0226714 | A1 | 8/2017 | Mitola et al. | |
| 2017/0328024 | A1 * | 11/2017 | Sauve | E02D 29/1427 |
| 2019/0136483 | A1 | 5/2019 | Nolle et al. | |
| 2019/0359461 | A1 | 11/2019 | Gretz | |
| 2020/0087884 | A1 | 3/2020 | Rigby | |
| 2021/0102354 | A1 | 4/2021 | Shokouhi | |

OTHER PUBLICATIONS

U.S. Appl. No. 17/807,818, filed Jun. 20, 2022, US 2022/0412039.
U.S. Appl. No. 18/487,680, filed Oct. 16, 2023.
WIPO, PCT Form ISA210, International Search Report for International Patent Application Serial No. PCT/US2022/034620, pp. 4 (Oct. 12, 2022).
WIPO, PCT Form ISA237, Written Opinion for International Patent Application Serial No. PCT/US2022/034620, pp. 8 (Oct. 12, 2022).
WIPO, PCT Form IPEA408, Written Opinion for International Patent Application Serial No. PCT/US2022/034620, pp. 5 (Jun. 7, 2023).

* cited by examiner

SELECTIVELY FRICTIONALLY ENGAGED HOLE COVER

BACKGROUND

This application is a continuation that claims the benefit of priority and is entitled to the filing date pursuant to 35 U.S.C. § 120 of U.S. Non-Provisional patent application Ser. No. 18/487,680, filed Oct. 16, 2023, the content of which is hereby incorporated by reference in its entirety.

The subject of this patent application relates generally to temporary covers for covering holes in paved surfaces so that vehicular traffic can safely travel thereover.

By way of background, when locating and verifying subsurface utilities (e.g., water, power, gas, telephone, sewer, cable, oil lines, reclaimed water, and so on) it is common practice to core approximately a 6-inch to 12-inch diameter hole though the asphalt or concrete. Once the asphalt or concrete core is removed, the field crew will then hydro excavate down to the utility to positively identify the line. Thereafter, the core is left open with the utility exposed to allow for survey crews, inspection crews, digging crews, drilling crews, etc. to visually identify the line they are working with and/or around.

During non-working hours, a cover (often called a "graduation cap" due to its appearance) is placed over the core hole to permit safe passage of pedestrians and vehicular traffic. Many current graduation caps are made from heavy-duty steel materials, with a large diameter steel pipe having a steel plate welded to the top end. The pipe portion is dropped into the bore hole, with the plate resting atop the rim of the hole, with only the weight of the graduation cap holding it within the hole. As high-speed vehicles drive over the plate, the graduation caps have issues with becoming dislodged from the core and ejected onto the street. This causes great damage to vehicles due to impact with the dislodged graduation cap and/or the open bore hole itself. What is needed is a bore hole cover that can withstand the stresses of vehicular traffic without becoming dislodged.

Aspects of the present invention fulfill these needs and provide further related advantages as described in the following summary.

SUMMARY

Aspects of the present invention teach certain benefits in construction and use which give rise to the exemplary advantages described below.

The present specification discloses a selectively frictionally engaged hole cover generally comprising a cover plate coupled to an engagement mechanism. The cover plate includes a top surface and a bottom surface opposite the top surface. The engagement mechanism includes an engagement plate selectively shiftable relative to the cover plate and configured to thereby shift an engagement member along a sloped wall and thus radially outwardly or inwardly. The engagement mechanism is coupled with the cover plate and extends from the bottom surface of the cover plate. During an insertion procedure, the engagement mechanism is configured to be positioned within the bore hole and supported at least initially therein by the cover plate that is configured to rest upon the paved surface and substantially cover the bore hole. And, during an engagement procedure, the engagement mechanism is configured to be actuated to cause a first movement of the engagement plate so as to shift the engagement member along the sloped wall radially outwardly to move the engagement member into frictional contact with the bore hole and to substantially prevent extraction of the engagement mechanism from the bore hole and substantially prevent lifting of the cover plate due to forces exerted by vehicular traffic thereupon.

Other features and advantages of aspects of the present invention will become apparent from the following more detailed description, taken in conjunction with the accompanying drawings, which illustrate, by way of example, the principles of aspects of the invention.

BRIEF DESCRIPTION OF THE DRAWINGS

The accompanying drawings, which are incorporated in and constitute a part of this specification, illustrate aspects of the disclosed subject matter in at least one of its exemplary embodiments, which are further defined in detail in the following description. Features, elements, and aspects of the disclosure are referenced by numerals with like numerals in different drawings representing the same, equivalent, or similar features, elements, or aspects, in accordance with one or more embodiments. The drawings are not necessarily to scale, emphasis instead being placed upon illustrating the principles herein described and provided by exemplary embodiments of the invention. In such drawings.

Listing of Reference Numbers Associated with Drawings

| Ref. No. | Element |
|---|---|
| 20 | Selectively frictionally engaged hole cover |
| 30 | Cover plate |

-continued

| Listing of Reference Numbers Associated with Drawings | |
|---|---|
| Ref. No. | Element |
| 32 | Top surface |
| 34 | Bottom surface |
| 36 | Access hole |
| 38 | Engagement mechanism support bracket |
| 40 | Sidewall |
| 42 | Support plate |
| 44 | Support plate hole |
| 46 | Cover plate skirt |
| 48 | Stand-off |
| 50 | Through-hole |
| 52 | Retainer plate |
| 54 | Retainer plate hole |
| 56 | Retainer plate skirt |
| 60 | Engagement mechanism |
| 62 | Screw |
| 64 | Head |
| 66 | Shank |
| 68 | Threaded portion |
| 72 | Engagement plate |
| 74 | Threaded hole |
| 76 | Boss |
| 78 | Lip |
| 80 | Sloped wall |
| 82 | Engagement member |
| H | Bore hole |
| W | Bore hole wall |
| P | Paved surface |
| C | Course |
| B | Base |
| S | Sub-grade |
| U | Utility |

DETAILED DESCRIPTION

The present specification discloses a selectively frictionally engaged hole cover for a bore hole cored from a paved surface that includes a cover plate configured to cover the bore hole and support vehicular traffic. An engagement mechanism is operably attached to the cover plate and extends down into the bore hole. The engagement mechanism is configured to be actuated by a user torque input that is transmitted through a screw threadably connected with an engagement plate to selectively raise or lower the engagement plate and thereby cause an engagement member to selectively engage or disengage the wall of the bore hole as the engagement member moves up or down a sloped wall and so selectively shifts radially outwardly or inwardly. When the engagement mechanism is engaged with the wall via the engagement member as urged radially outwardly under the influence of the engagement plate upon rotation of the screw by the user, the selectively frictionally engaged hole cover is prevented from being unintentionally extracted from the hole. The selectively frictionally engaged hole cover effectively provides a temporary cover for a bore hole in a road, parking lot, or other paved surface that supports vehicular traffic, that prevents extraction due to vibrations of passing traffic, and that thus prevents damage to cars and their occupants.

Figure 1:
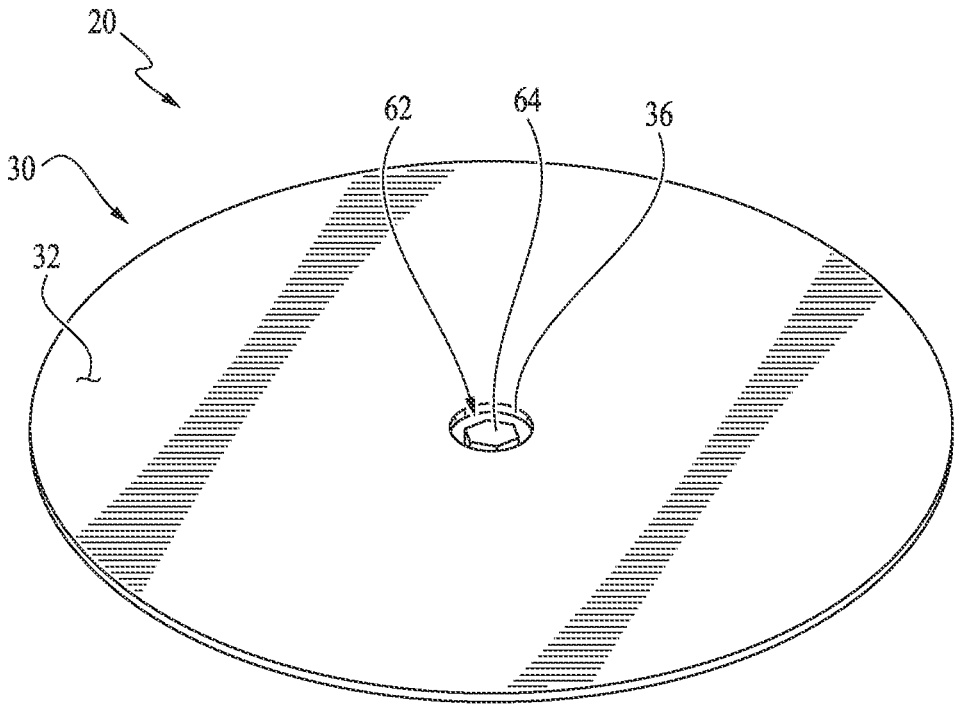
FIG. 1 is an assembled top perspective view of an exemplary embodiment of a selectively frictionally engaged hole cover disclosed herein.
Figure 2:
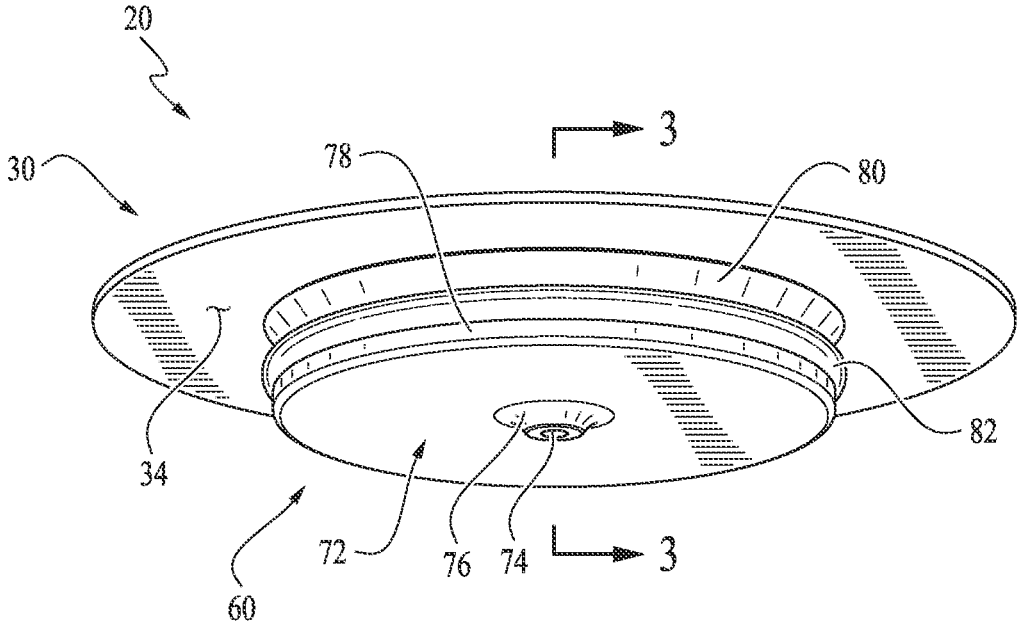
FIG. 2 is an assembled bottom perspective view of the selectively frictionally engaged hole cover of FIG. 1.
Figure 3:
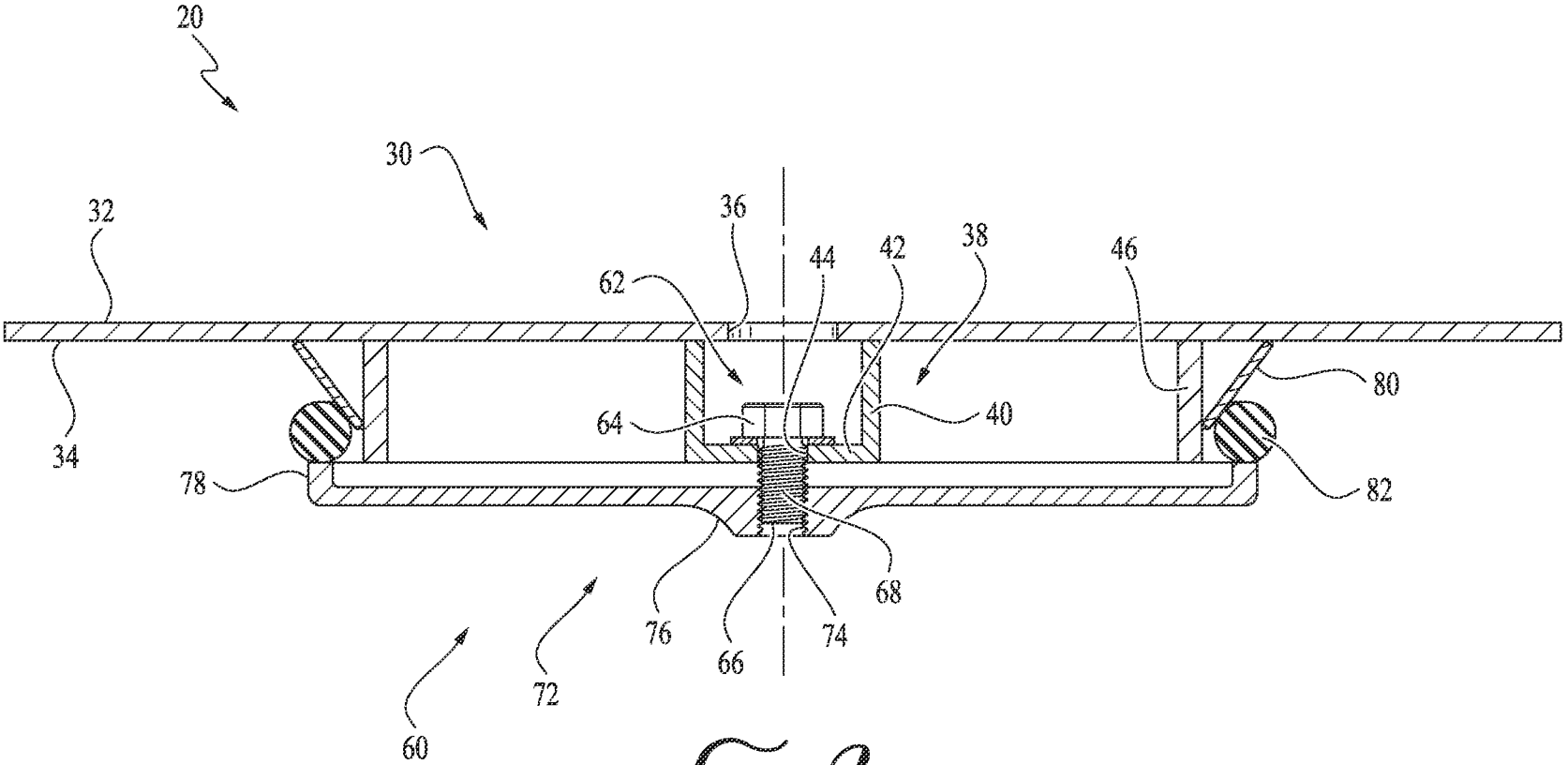
FIG. 3 is an enlarged side cross-sectional view of the selectively frictionally engaged hole cover of FIG. 1 taken from line 3-3 of FIG. 2.

Referring first to FIGS. 1-3, an example embodiment of the present selectively frictionally engaged hole cover 20 is illustrated and generally includes a cover plate 30 with an engagement mechanism 60 coupled thereto and extending from the bottom surface 34 of the cover plate 30. The engagement mechanism 60 can have a variety of configurations that convert a user torque input into radial or lateral expansion to grip or frictionally engage the wall W of the bore hole H (as exemplified in FIGS. 5 and 10). The engagement mechanism 60 generally includes an engagement plate 72 operably spaced from and configured to shift up and down relative to the bottom surface 34 of the cover plate 30 so as to thereby cause an engagement member 82 in contact with the engagement plate 72 to selectively move up and down along a sloped wall 80 offset from the engagement plate 72 and thus shift outwardly or inwardly radially or laterally. A screw 62 operably installed between the cover plate 30 and the engagement plate 72 selectively raises or lowers the engagement plate 72 as rotation or torque is applied to the screw 62, which is, in one or more embodiments, accessed by an appropriate tool (e.g., a socket wrench, a T-handle wrench, a speed or crack handle wrench, an impact wrench, and numerous other hand or power tools that can be used to impart a torque on the screw 62) through an access hole 36. Thus, upon actuation (applied through a user torque input), the screw 62 rotates and amplifies the magnitude of the torque and/or converts the torque to generally radial or lateral movement of the engagement member 82 (e.g., movement toward/from the bore hole wall W).

With continued reference to the illustrated example embodiment of FIGS. 1-3, the cover plate 30 is formed having a central access hole 36 that communicates between the top surface 32 and the bottom surface 34 of the cover plate 30. An engagement mechanism support bracket 38 extends from the bottom surface 34 (i.e., facing into the bore hole H when installed) substantially centered about the access hole 36, the engagement mechanism support bracket 38 having an annular sidewall 40 terminating in a support plate 42 spaced from the cover plate 32 and having a support plate hole 44 formed therein offset from and substantially aligned with the access hole 36 formed in the cover plate 30. The sidewall 40 may be attached to the bottom surface 34 of the cover plate 30 at its top edge, for example, as by welding the top edge to the bottom surface 34, and similarly the support plate 42 may be integral with or connected to the sidewall 40 by welding or other appropriate means now known or later developed. The screw 62 has a head 64 configured to pass through the access hole 36 and seat on the support plate 42 and a shank 66 configured to pass through the support plate hole 44 with a distal threaded portion 68 configured to threadably engage a threaded hole 74 formed centrally in the offset engagement plate 72, such that rotation of the screw 62 as by operably engaging the head 64 via the access hole 36 with an appropriate tool thereby raises or lowers the engagement plate 72 relative to the cover plate 30 and thus the engagement mechanism support bracket 38 and its support plate 42 on which the screw 62 seats, more about which is said below in connection with FIGS. 4 and 5. A raised boss 76 may be formed about the threaded hole 74 simply to provide for more material thickness where the threaded hole 74 is formed in the engagement plate 72. As best seen in FIG. 3, radially outwardly of the central engagement mechanism support bracket 38 and also extending downwardly from the bottom surface 34 of the cover plate 30 (i.e., facing into the bore hole H when installed) is a cover plate skirt 46, which may again be integral with or connected to the cover plate 30 as by welding or otherwise. Spanning between the cover plate skirt 46 and the bottom surface 34 is an angled or sloped wall 80 along which the engagement member 82 selectively shifts, which sloped wall 80 may again be integral with or connected to the cover plate 30 and the cover plate skirt 46 as by welding or otherwise. In a bit more detail, the engagement member 82 may be formed as an annular gasket or o-ring having a nominal or "at rest" diameter approximately the same as or slightly larger than that of the cover plate skirt 46 and having a degree of elasticity so as to stretch and expand as the engagement member 82 transitions along the sloped wall 80 that effectively provides an expanding or increasing diameter on which the engagement member 82 seats. To support the engagement member 82 vertically or from beneath and selectively shift the engagement member 82 upwardly along the sloped wall 80 and thus radially outwardly as the engagement plate 72 is shifted upwardly due to rotation of the screw 62, the engagement plate 72 is further formed having a perimeter lip 78 on which the engagement member 82 rests. Dimensionally, as will also be further appreciated from FIGS. 4 and 5 and the related discussion, the diameter of the engagement plate 72 and thus the annular position of the lip 78 is substantially vertically aligned with the center of the engagement member 82 profile and of the midline of the sloped wall 80, which outer annular alignment or general profile of the engagement mechanism 60 substantially conforms to or is slightly clear of or inset from the respective bore hole wall W, while of course the diameter of the cover plate 30 is greater than that of the engagement plate 72 and the engagement member 82 and of the bore hole H itself so as to span and seat over the bore hole H even as the engagement mechanism 60 is seated within the bore hole H. While a particular configuration of the exemplary selectively frictionally engaged hole cover 20 and thus of the cover plate 30 and engagement mechanism 60 is shown and described, it will be appreciated by those skilled in the art that the invention is not so limited and other configurations and related assembly and operability arrangements are possible according to aspects of the present invention without departing from its spirit and scope. By way of illustration and not limitation, the sizes and shapes of the various components can vary, and particularly the engagement member 82, while shown and described as an annular gasket or o-ring, may take other forms; or the gasket-type member 82 may be sized and configured to itself not frictionally engage the bore hole wall W but instead to support other operably coupled engagement members configured, for example, as curved tabs or pads or other surfaces that in cooperation with the gasket-like portion of the engagement member 82 are selectively forced radially or laterally outwardly and into frictional contact or engagement with the bore hole wall W as they are lifted along the sloped wall 80 of the engagement mechanism 60 by upward movement of the engagement plate 72, which tabs or pads or the like may be configured to grip the wall and include a radius similar to the bore hole H radius. Regardless, those skilled in the art will appreciate that the selectively frictionally engaged hole cover 20 according to aspects of the present invention is a relatively simple mechanical arrangement with fewer mechanical or moving components, thereby reducing or eliminating potential failure points, and also a relatively more compact design for better storage efficiency. Of course, such a hole cover apparatus 20 can be easily scaled for use with larger or smaller core hole H sizes (e.g., 6-inch or 12-inch diameter hole).

Figure 4:
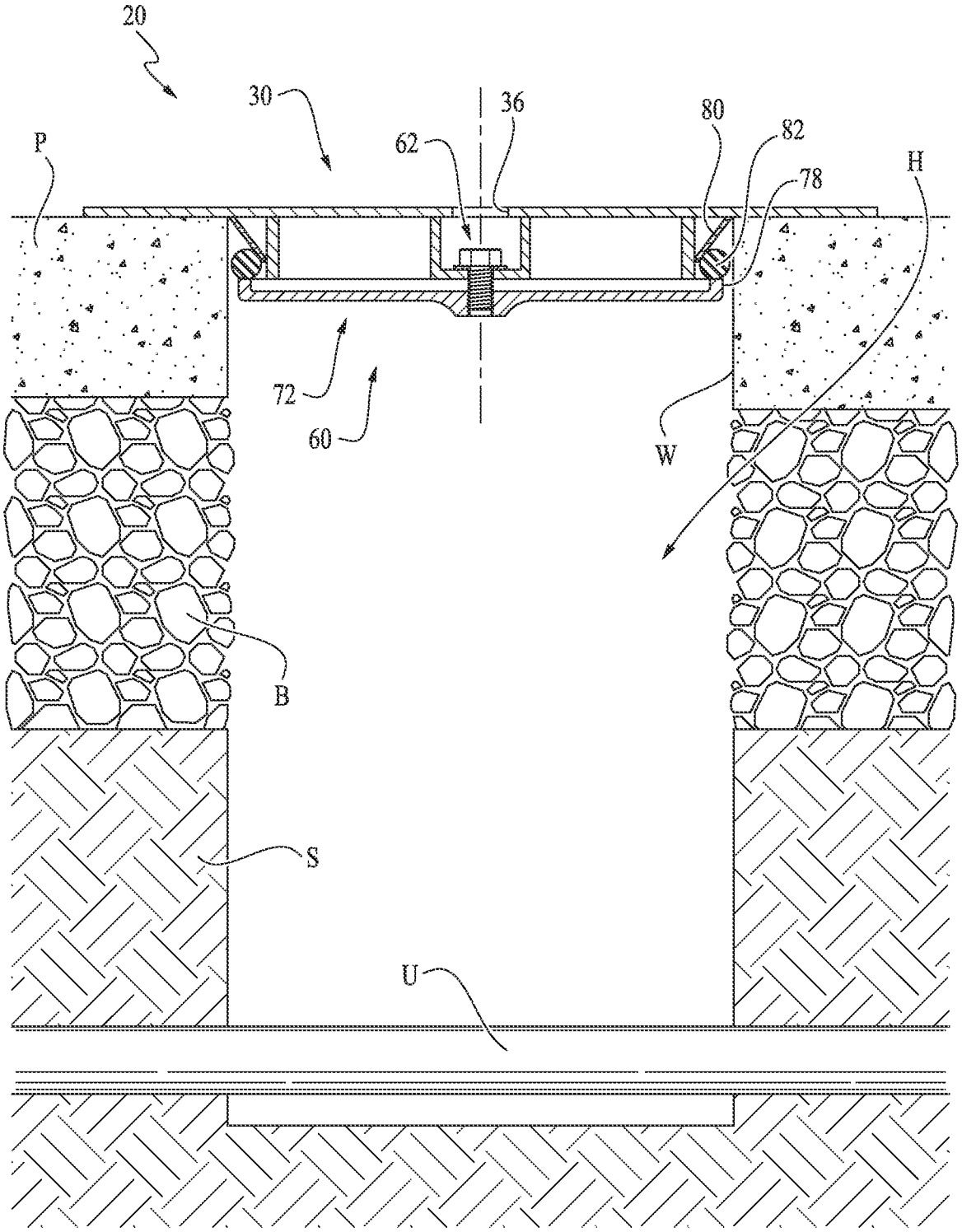
FIG. 4 is a reduced scale side view of the selectively frictionally engaged hole cover of FIG. 1, showing the selectively frictionally engaged hole cover inserted within a bore hole formed through a paved surface in the unengaged configuration.
Figure 5:
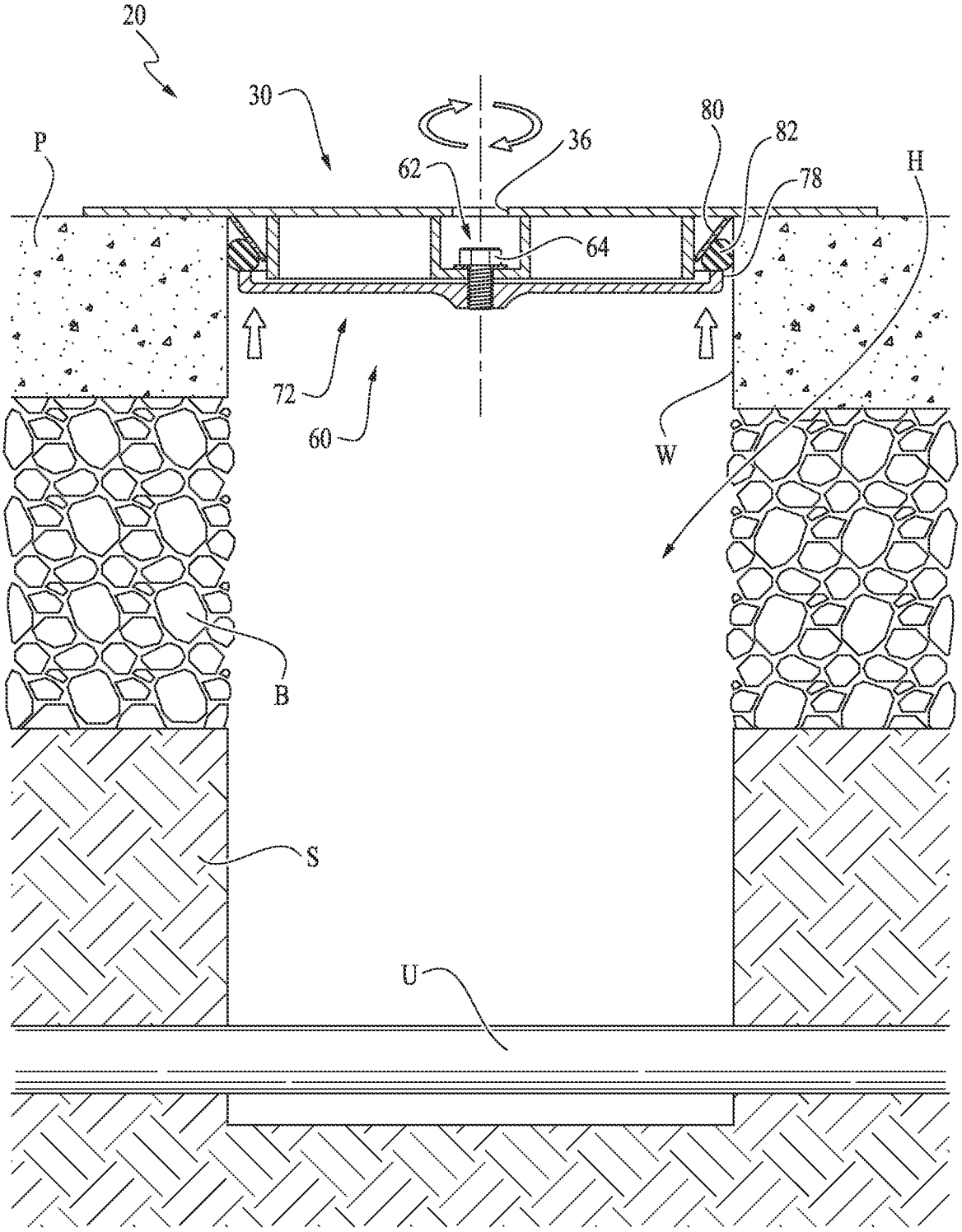
FIG. 5 is a reduced scale side view of the selectively frictionally engaged hole cover of FIG. 1, showing the selectively frictionally engaged hole cover inserted within a bore hole formed through a paved surface in the engaged configuration.

Looking now at FIGS. 4 and 5, the insertion and engagement procedures, respectively, can be seen. The bore hole H is formed by coring through the paved surface P (e.g., asphalt, concrete, or other form of paved surface appropriate for supporting vehicular traffic on a roadway, parking lot, or other area). The bore hole H is further dug through any other layers beneath the paved surface P, such as the illustrated base B or subgrade S layers, until the utility U is sufficiently exposed. The selectively frictionally engaged hole cover 20 is inserted within the bore hole H, with the engagement mechanism 60 positioned within the bore hole H. The cover plate 30 is sized larger than the bore hole H, so that the cover plate 30 rests on top of the paved surface P. The engagement mechanism 60 and specifically its engagement member 82 are configured such that when the hole cover 20 is inserted with the cover plate 30 resting on the paved surface P, the engagement member 82 is positioned adjacent to the bore hole wall W here in the vicinity of or at the level of the paved surface P. Turning to FIG. 5, the head 64 of the screw 62 is rotated in a clockwise direction using an appropriate tool to provide the required torque, from the point of view of the user standing on top of the paved surface P. This clockwise rotation causes the engagement plate 72 to move upward on the screw 62, thus lifting the engagement member 82 along the sloped wall 80 and so shifting the engagement member 82 radially or laterally outwardly into contact with the wall W of the bore hole H. In this way, the frictional engagement between the engagement member 82 and the bore hole wall W creates a mechanical interference that prohibits extraction of the selectively frictionally engaged hole cover 20 from the bore hole H, even under maximum expected vehicular traffic conditions, such as class one vehicles (under 6,000 pounds) up to and exceeding class eight vehicles (over 33,000 pounds) traveling at highway speeds. To remove the selectively frictionally engaged hole cover 20, the user simply rotates the head 64 of the screw 62 in the counterclockwise direction to shift the engagement plate 72 downwardly and thus allow the engagement member 82 to shift downwardly along the inwardly sloped wall 80 and thus radially or laterally inwardly so as to disengage from or come out of contact with the bore hole wall W as shown in FIG. 4. It will be appreciated by those skilled in the art that by having contact about all or substantially all the circumference or between the perimeter of the engagement mechanism 60 and specifically the engagement member 82 and the bore hole wall W, the selectively frictionally engaged hole cover 20 according to aspects of the present invention is less susceptible to shifting and maintains its orientation in the cored hole H, versus other designs that might tend to get point loaded when cars and trucks drive over. Relatedly, the present invention by making perimeter contact or frictionally engaging the bore hole wall W at numerous points of contact does not dig into the wall W even while sufficiently engaging the wall W to prevent unwanted dislodging or removal of the hole cover 20, thereby not compromising the integrity of the cored hole H even as the hole cover 20 is inserted and removed. It will be further appreciated that even at a relatively shallow depth within the bore hole H, the selectively frictionally engaged hole cover 20 is substantially secured within the hole H even pre-actuation based on the close clearance between the engagement member 82 and the bore hole wall W.

Referring now to FIGS. 6-10, another example embodiment of the present selectively frictionally engaged hole cover 20 is disclosed, and again generally includes a cover plate 30 with an engagement mechanism 60 coupled thereto and extending from the bottom surface 34 of the cover plate 30. The engagement mechanism 60 once more can have a variety of configurations that convert a user torque input into radial or lateral expansion to grip or frictionally engage the wall W of the bore hole H (as exemplified in FIGS. 5 and 10). The engagement mechanism 60 once again generally includes an engagement plate 72 operably spaced from and configured to shift up and down relative to the bottom surface 34 of the cover plate 30 so as to thereby cause an engagement member 82 in contact with the engagement plate 72 to selectively move up and down along a sloped wall 80 offset from the engagement plate 72 and thus shift outwardly or inwardly radially or laterally. Here, in the alternative embodiment, a stand-off 48 is provided between the cover plate 30 and the engagement plate 72 so as to space the two further apart, more about which is said below. A screw 62 is still operably installed between the cover plate 30 and the engagement plate 72, here just being relatively longer so as to pass through the stand-off 48, to selectively raise or lower the engagement plate 72 as rotation or torque is applied to the screw 62, which is, in one or more embodiments, accessed by an appropriate tool (e.g., a socket wrench, a T-handle wrench, a speed or crack handle wrench, an impact wrench, and numerous other hand or power tools that can be used to impart a torque on the screw 62) through the access hole 36 formed in the cover plate 30. Thus, upon actuation (applied through a user torque input), the screw 62 rotates and amplifies the magnitude of the torque and/or converts the torque to generally radial or lateral movement of the engagement member 82 (e.g., movement toward/from the bore hole wall W).

Figure 6:
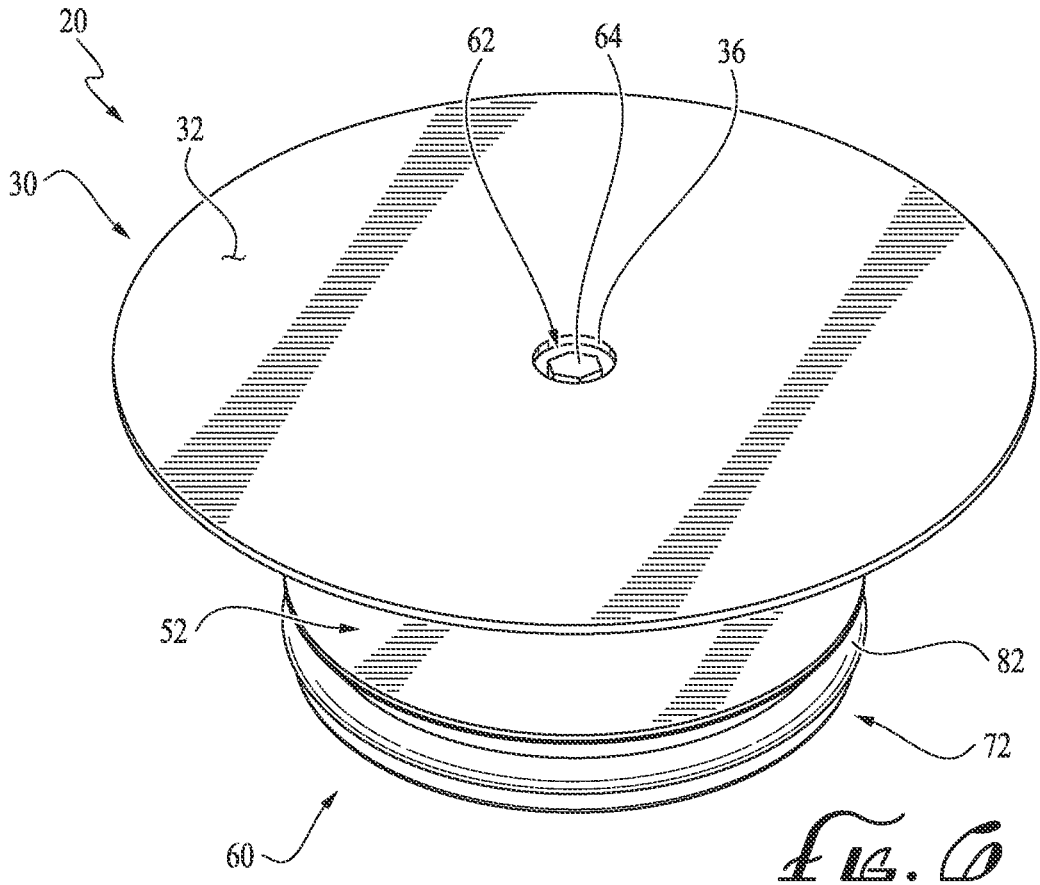
FIG. 6 is an assembled top perspective view of another exemplary embodiment of a selectively frictionally engaged hole cover disclosed herein.
Figure 7:
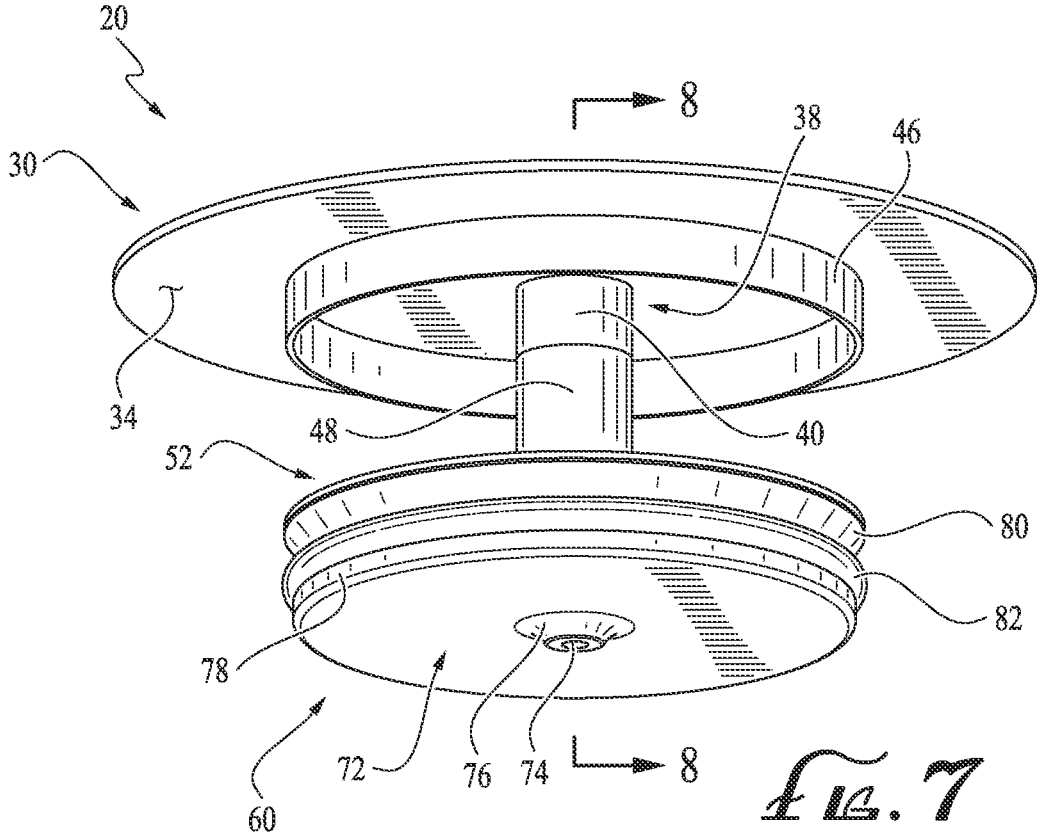
FIG. 7 is an assembled bottom perspective view of the anchored hole cover of FIG. 6.
Figure 8:
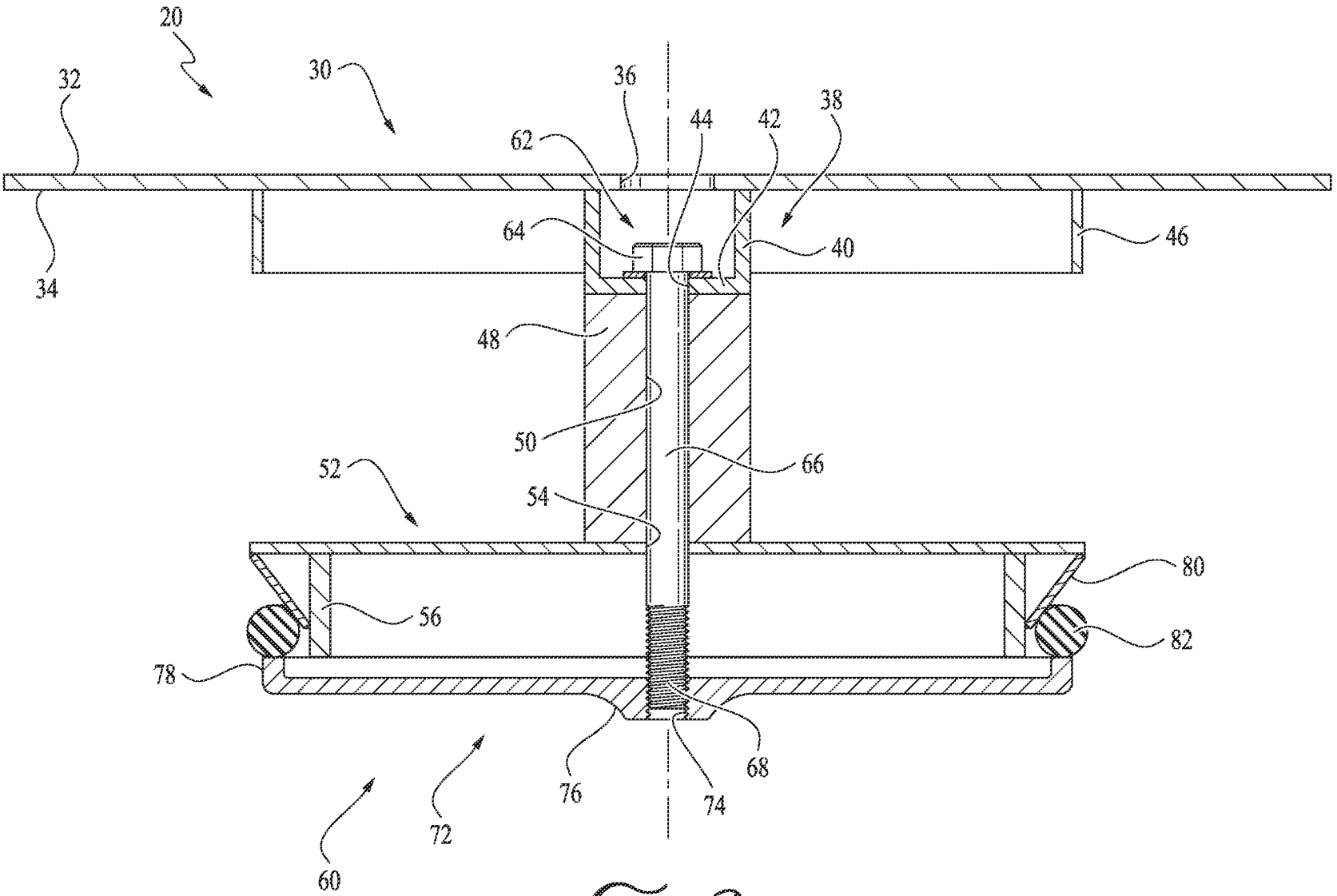
FIG. 8 is an enlarged side cross-sectional view of the selectively frictionally engaged hole cover of FIG. 6 taken from line 8-8 of FIG. 7.

Looking particularly at FIGS. 6-8, the cover plate 30 is again formed having a central access hole 36 that communicates between the top surface 32 and the bottom surface 34 of the cover plate 30 with an engagement mechanism support bracket 38 extending from the bottom surface 34 (i.e., facing into the bore hole H when installed) substantially centered about the access hole 36, the engagement mechanism support bracket 38 having an annular sidewall 40 terminating in a support plate 42 spaced from the cover plate 32 and having a support plate hole 44 formed therein offset from and substantially aligned with the access hole 36 formed in the cover plate 30. The sidewall 40 may be attached to the bottom surface 34 of the cover plate 30 at its top edge, for example, as by welding the top edge to the bottom surface 34, and similarly the support plate 42 may be integral with or connected to the sidewall 40 by welding or other appropriate means now known or later developed. Aligned with and adjacent to the support plate 42 and extending downwardly or distally therefrom is the stand-off 48 having its own through-hole 50 aligned with the support plate hole 42, and opposite of the support plate 42 the stand-off 48 engages a retainer plate 52 that is substantially parallel to the cover plate 30 and the support plate 42, with the retainer plate 52 again joined with the stand-off 48 via welding or any other appropriate attachment technique now known or later developed. The screw 62 again has a head 64 configured to pass through the access hole 36 and seat on the support plate 42 and here has a relatively longer shank 66 configured to pass through the support plate hole 44 as well as the stand-off through-hole 50 and an axially aligned retainer plate hole 54 and thus with a distal threaded portion 68 configured to threadably engage the threaded hole 74 formed centrally in the offset engagement plate 72, such that rotation of the screw 62 as by operably engaging the head 64 via the access hole 36 with an appropriate tool thereby raises or lowers the engagement plate 72 relative to the retainer plate 52, more about which is said below in connection with FIGS. 9 and 10. A raised boss 76 may once again be formed about the threaded hole 74 to provide for more material thickness where the threaded hole 74 is formed in the engagement plate 72. As best seen in FIG. 8, a retainer plate skirt 56 is formed or installed on the retainer plate 52 extending downwardly or distally therefrom (i.e., facing into the bore hole H when installed), which may again be integral with or connected to the cover plate 30 as by welding or otherwise. Spanning between the retainer plate skirt 56 and the retainer plate 52 is the angled or sloped wall 80 along which the engagement member 82 selectively shifts, which sloped wall 80 may again be integral with or connected to the retainer plate 52 and the retainer plate skirt 56 as by welding or otherwise. In a bit more detail, the engagement member 82 may once again be formed as an annular gasket or o-ring having a nominal or "at rest" diameter approximately the same as or slightly larger than that of the retainer plate skirt 56 and having a degree of elasticity so as to stretch and expand as the engagement member 82 transitions along the sloped wall 80 that effectively provides an expanding or increasing diameter on which the engagement member 82 seats. To support the engagement member 82 vertically or from beneath and selectively shift the engagement member 82 upwardly along the sloped wall 80 and thus radially outwardly as the engagement plate 72 is shifted upwardly due to rotation of the screw 62, the engagement plate 72 is further formed having a perimeter lip 78 on which the engagement member 82 rests. Also, radially outwardly of the central engagement mechanism support bracket 38 and also extending downwardly from the bottom surface 34 of the cover plate 30 (i.e., facing into the bore hole H when installed) is a cover plate skirt 46, which here does not serve as a support for the sloped wall 80 but instead just as an upper or proximal retention or guide for the hole cover 20 as the entire assembly is positioned within the bore hole H, ensuring that the relatively longer or taller hole cover 20 does not get cocked as it is being inserted and thus that the cover plate 30 is substantially centered over the bore hole H as the cover plate 30 rests on the paved surface P. Dimensionally, as will also be further appreciated from FIGS. 9 and 10 and the related discussion, the diameter of the engagement plate 72 and thus the annular position of the lip 78 is substantially vertically aligned with the center of the engagement member 82 profile and of the midline of the sloped wall 80 as well as the offset cover plate skirt 46, or more precisely the outer diameters of the cover plate skirt 46, the retainer plate 52, and the engagement member 82 are approximately equal, which outer annular alignment or general profile of the engagement mechanism 60 substantially conforms to or is slightly clear of or inset from the respective bore hole wall W, while of course the diameter of the cover plate 30 is greater than that of the retainer plate 52, the engagement plate 72, and the engagement member 82 and of the bore hole H itself so as to span and seat over the bore hole H even as the engagement mechanism 60 is seated within the bore hole H. While a particular configuration of the exemplary selectively frictionally engaged hole cover 20 and thus of the cover plate 30 and engagement mechanism 60 is shown and described, it will be appreciated by those skilled in the art that the invention is not so limited and other configurations and related assembly and operability arrangements are possible according to aspects of the present invention without departing from its spirit and scope. By way of illustration and not limitation, the sizes and shapes of the various components can vary, and particularly the engagement member 82, while shown and described as an annular gasket or o-ring, may take other forms; or the gasket-type member 82 may be sized and configured to itself not frictionally engage the bore hole wall W but instead to support other operably coupled engagement members configured, for example, as curved tabs or pads or other surfaces that in cooperation with the gasket-like portion of the engagement member 82 are selectively forced radially or laterally outwardly and into frictional contact or engagement with the bore hole wall W as they are lifted along the sloped wall 80 of the engagement mechanism 60 by upward movement of the engagement plate 72, which tabs or pads or the like may be configured to grip the wall and include a radius similar to the bore hole H radius. Regardless, those skilled in the art will appreciate that the selectively frictionally engaged hole cover 20 according to aspects of the present invention is a relatively simple mechanical arrangement with fewer mechanical or moving components, thereby reducing or eliminating potential failure points, and also a relatively more compact design for better storage efficiency. Of course, such a hole cover apparatus 20 can be easily scaled for use with larger or smaller core hole H sizes (e.g., 6-inch or 12-inch diameter hole).

Figure 9:
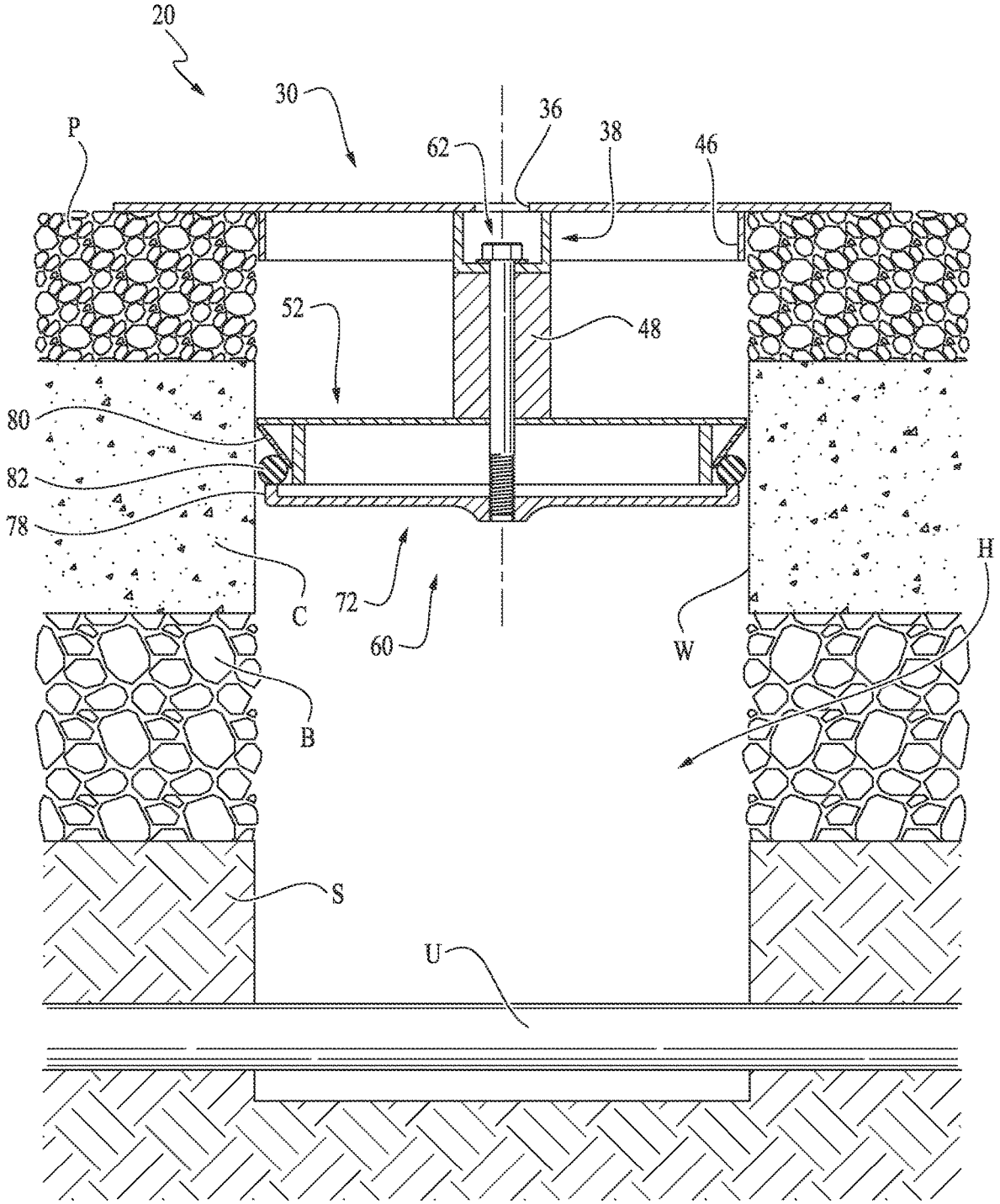
FIG. 9 is a reduced scale side view of the selectively frictionally engaged hole cover of FIG. 6, showing the selectively frictionally engaged hole cover inserted within a bore hole formed through a paved surface in the unengaged configuration.
Figure 10:
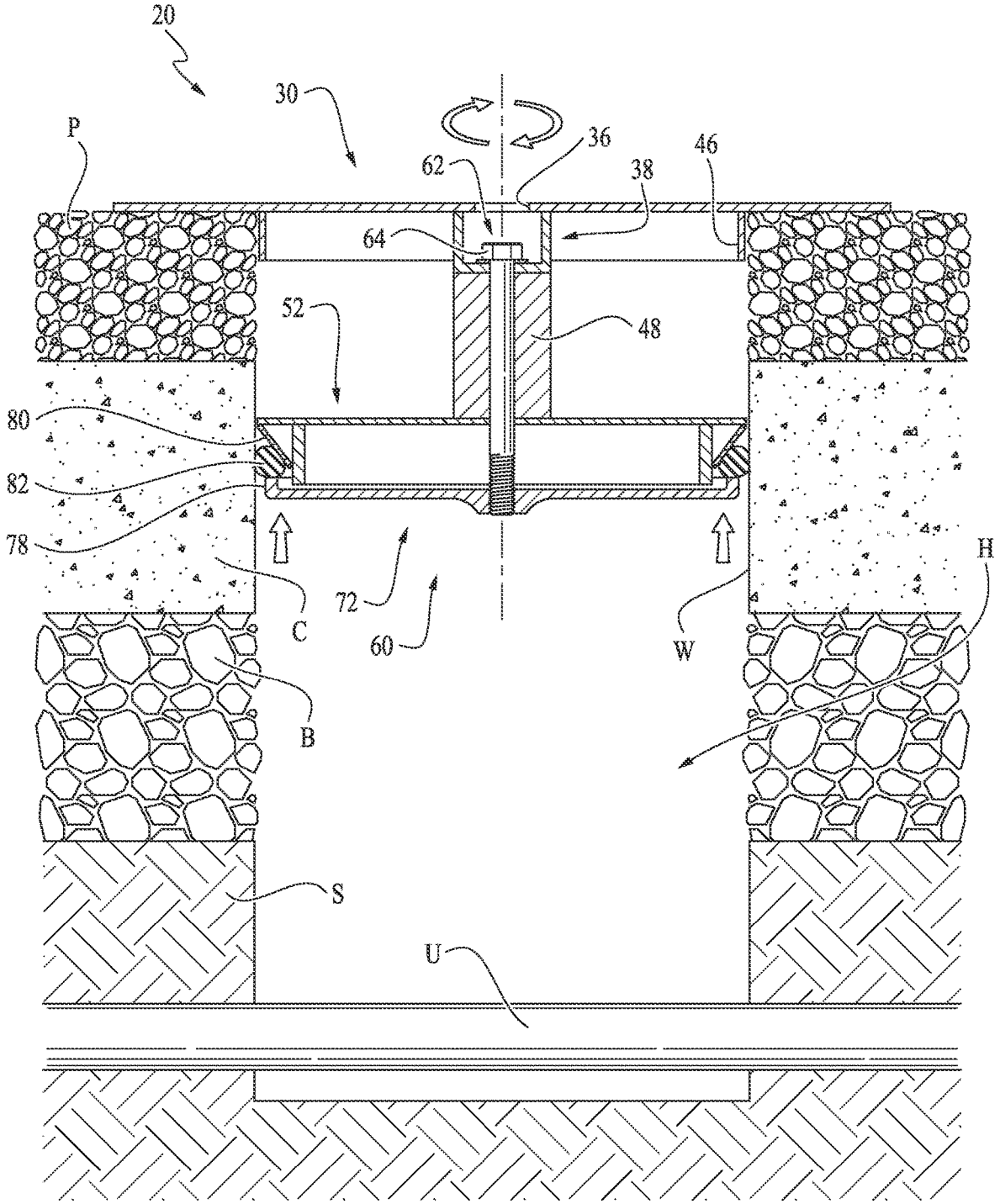
FIG. 10 is a reduced scale side view of the selectively frictionally engaged hole cover of FIG. 6, showing the selectively frictionally engaged hole cover inserted within a bore hole formed through a paved surface in the engaged configuration.

In use of the alternative exemplary selectively frictionally engaged hole cover 20 with stand-off 48 for increased height or increased depth of positioning the engagement mechanism 60 and engagement member 82 specifically within the bore hole H, referring to FIGS. 9 and 10, the insertion and engagement procedures, respectively, can be seen. The bore hole H is again formed by coring through the paved surface P (e.g., asphalt, concrete, or other form of paved surface appropriate for supporting vehicular traffic on a roadway, parking lot, or other area). The bore hole H is further dug through any other layers beneath the paved surface P, such as the illustrated intermediate course C and the base B or subgrade S layers, until the utility U is sufficiently exposed. Notably, as illustrated, the uppermost paved surface P may in some cases be a concrete or aggregate or other material that is relatively coarse beneath which may be an intermediate layer or course C that is relatively finer and so may provide a relatively smoother bore hole wall W for the engagement mechanism 60 and specifically the engagement member 82 to selectively seat against and frictionally engage. More generally, it will be appreciated that the deeper the engagement mechanism 60 is inserted within the bore hole H, the better the retention of the hole cover 20, regardless of the layers and the characteristics of the bore hole wall W at various depths. And so once more, to place the selectively frictionally engaged hole cover 20, it is inserted within the bore hole H as by positioning the engagement mechanism 60 within the bore hole H, with the cover plate 30 again sized larger than the bore hole H so that the cover plate 30 rests on top of the paved surface P. The engagement mechanism 60 and specifically its engagement member 82 are configured such that when the hole cover 20 is inserted with the cover plate 30 resting on the paved surface P, the engagement member 82 is positioned adjacent to the bore hole wall W here in the vicinity of or at the level of the intermediate course C. Turning to FIG. 10, the head 64 of the screw 62 is rotated in a clockwise direction using an appropriate tool to provide the required torque, from the point of view of the user standing on top of the paved surface P. This clockwise rotation causes the engagement plate 72 to move upward on the screw 62, thus lifting the engagement member 82 along the sloped wall 80 and so shifting the engagement member 82 radially or laterally outwardly into contact with the wall W of the bore hole H. In this way, the frictional engagement between the engagement member 82 and the bore hole wall W creates a mechanical interference that prohibits extraction of the selectively frictionally engaged hole cover 20 from the bore hole H, even under maximum expected vehicular traffic conditions, such as class one vehicles (under 6,000 pounds) up to and exceeding class eight vehicles (over 33,000 pounds) traveling at highway speeds. To remove the selectively frictionally engaged hole cover 20, the user simply rotates the head 64 of the screw 62 in the counterclockwise direction to shift the engagement plate 72 downwardly and thus allow the engagement member 82 to shift downwardly along the inwardly sloped wall 80 and thus radially or laterally inwardly so as to disengage from or come out of contact with the bore hole wall W as shown in FIG. 9. It will again be appreciated by those skilled in the art that by having contact about all or substantially all the circumference or between the perimeter of the engagement mechanism 60 and specifically the engagement member 82 and the bore hole wall W, the selectively frictionally engaged hole cover 20 according to aspects of the present invention is less susceptible to shifting and maintains its orientation in the cored hole H, versus other designs that might tend to get point loaded when cars and trucks drive over. Relatedly, the present invention by making perimeter contact or frictionally engaging the bore hole wall W at numerous points of contact does not dig into the wall W even while sufficiently engaging the wall W to prevent unwanted dislodging or removal of the hole cover 20, thereby not compromising the integrity of the cored hole H even as the hole cover 20 is inserted and removed. It will be further appreciated that even at a relatively shallow depth within the bore hole H, and certainly even moreso at increased depth as in the alternative exemplary embodiment, the selectively frictionally engaged hole cover 20 is substantially secured within the hole H even pre-actuation based on the close clearance between the engagement member 82 and the bore hole wall W. Indeed, the selectively frictionally engaged hole cover 20 according to aspects of the present invention, whether short (FIGS. 1-5) or long (FIGS. 6-10), is well suited to capping or covering a variety of other holes, such as in walls and other support structures and not just horizontal surfaces such as roads and the like.

In one or more example embodiments, the cover plate 30 is made of steel plate material sufficiently strong and thick to support heavy vehicular traffic thereupon. The weight bearing capacity of the cover plate 30 is up to 10,000 pounds, or up to 20,000 pounds, or up to 30,000 pounds, or up to 40,000 pounds, or up to 50,000 pounds, or up to 60,000 pounds, or up to 70,000 pounds, or up to 80,000 pounds, or up to 90,000 pounds, or up to or exceeding 100,000 pounds.

In one or more example embodiments, the engagement mechanism 60 is sufficiently strong to resist an extraction force up to 1,000 pounds, or up to 3,000 pounds, or up to 5,000 pounds, or up to 7,000 pounds, or up to or exceeding 10,000 pounds.

Aspects of the present specification may also be described by the following numbered embodiments:

1. A selectively frictionally engaged hole cover for covering a bore hole formed through a paved surface, the selectively frictionally engaged hole cover comprising: a cover plate having a top surface and a bottom surface opposite the top surface, the top surface being configured to support safe passage of pedestrians and vehicular traffic across the selectively frictionally engaged hole cover; and an engagement mechanism coupled with the cover plate and extending from the bottom surface of the cover plate, the engagement mechanism having an engagement plate selectively shiftable relative to the cover plate and configured to thereby shift an engagement member along a sloped wall and thus radially outwardly or inwardly; wherein, during an insertion procedure, the engagement mechanism is configured to be positioned within the bore hole and supported at least initially therein by the cover plate that is configured to rest upon the paved surface and substantially cover the bore hole; and wherein, during an engagement procedure, the engagement mechanism is configured to be actuated to cause a first movement of the engagement plate so as to shift the engagement member along the sloped wall radially outwardly to move the engagement member into frictional contact with the bore hole to substantially prevent extraction of the engagement mechanism from the bore hole and to substantially prevent lifting of the cover plate due to forces exerted by vehicular traffic thereupon.

2. The selectively frictionally engaged hole cover of embodiment 1, wherein, during a disengagement procedure, the engagement mechanism is configured to be actuated to cause a second movement of the engagement plate so as to shift the engagement member along the sloped wall radially inwardly to allow the engagement member to move out of frictional contact with the bore hole and permit extraction of the engagement mechanism from the bore hole.

3. The selectively frictionally engaged hole cover of embodiments 1 or 2, wherein the engagement mechanism further comprises a screw operably installed between the cover plate and the engagement plate, the screw having a head and a shank extending from the head, the shank having a threaded portion formed thereon opposite the head.

4. The selectively frictionally engaged hole cover of embodiment 3, wherein actuation of the engagement mechanism comprises rotation of the screw in a first rotational direction to cause the first movement and rotation of the screw in a second rotational direction opposite the first rotational direction to cause the second movement.

5. The selectively frictionally engaged hole cover of embodiments 3 or 4, wherein the cover plate further comprises an access hole, the head of the screw being situated substantially flush or below the top surface of the cover plate and sufficiently aligned with the access hole to permit actuation of the screw through the access hole.

6. The selectively frictionally engaged hole cover of embodiment 5, wherein the cover plate further comprises an engagement mechanism support bracket having a sidewall extending from the bottom surface of the cover plate about the access hole and further having a support plate coupled with the sidewall opposite of the cover plate, the support plate having a support plate hole sufficiently aligned with the access hole for receipt therethrough of a shank of the screw while the head of the screw seats on the support plate.

7. The selectively frictionally engaged hole cover of embodiment 6, wherein a stand-off is installed adjacent to the support plate of the engagement mechanism support bracket, the stand-off having a through-hole for receipt therethrough of the shank of the screw, the shank having sufficient length to pass out of the through-hole of the stand-off.

8. The selectively frictionally engaged hole cover of embodiment 7, wherein a retainer plate is installed adjacent to the stand-off opposite the support plate of the engagement mechanism support bracket, the retainer plate having a retainer plate hole sufficiently aligned with the through-hole of the stand-off for receipt therethrough of the shank of the screw.

9. The selectively frictionally engaged hole cover of embodiment 8, wherein the sloped wall is installed so as to extend downwardly and inwardly from the retainer plate, whereby the engagement member shifts up and down along the sloped wall and thus radially outwardly and inwardly as the engagement plate shifts up and down relative to the retainer plate.

10. The selectively frictionally engaged hole cover of embodiment 9, wherein a retainer plate skirt is formed extending downwardly from the retainer plate, and further wherein the sloped wall is configured at an angle spanning between the retainer plate and the retainer plate skirt.

11. The selectively frictionally engaged hole cover of any of embodiments 8-10, wherein the outer edge of the retainer plate and the outer edge of the engagement member are substantially vertically aligned.

12. The selectively frictionally engaged hole cover of any one of embodiments 3-11, wherein the engagement plate comprises a substantially central threaded hole for selective receipt of the threaded portion of the screw.

13. The selectively frictionally engaged hole cover of embodiment 12, wherein the engagement plate further comprises a boss in which the threaded hole is formed.

14. The selectively frictionally engaged hole cover of any one of embodiments 1-13, wherein a cover plate skirt is formed extending downwardly from the bottom surface of the cover plate.

15. The selectively frictionally engaged hole cover of embodiment 14, wherein the sloped wall is configured at an angle spanning between the cover plate and the cover plate skirt.

16. The selectively frictionally engaged hole cover of embodiment 14, wherein the cover plate skirt and the outer edge of the engagement member are substantially vertically aligned.

17. The selectively frictionally engaged hole cover of any one of embodiments 1-16, wherein the engagement plate comprises a perimeter lip oriented to contact the engagement member in shifting the engagement member along the sloped wall as the engagement plate is shifted relative to the cover plate.

18. A selectively frictionally engaged hole cover for covering a bore hole formed through a paved surface, the selectively frictionally engaged hole cover comprising: a cover plate having a top surface and a bottom surface opposite the top surface, the top surface being configured to support safe passage of pedestrians and vehicular traffic across the selectively frictionally engaged hole cover, the cover plate further having a cover plate skirt formed extending downwardly from the bottom surface of the cover plate; and an engagement mechanism coupled with the cover plate and extending from the bottom surface of the cover plate, the engagement mechanism having an engagement plate selectively shiftable relative to the cover plate, the engagement mechanism further having a screw operably installed between the cover plate and the engagement plate, the screw having a head and a shank extending from the head, the shank having a threaded portion formed thereon opposite the head, the engagement plate having a substantially central threaded hole for selective receipt of the threaded portion of the screw, the engagement mechanism further having a sloped wall configured at an angle spanning between the cover plate and the cover plate skirt, the engagement mechanism further having an engagement member in contact with both the engagement plate and the sloped wall, the engagement plate configured to thereby shift the engagement member along the sloped wall and thus radially outwardly or inwardly as the engagement plate shifts relative to the cover plate;

wherein, during an insertion procedure, the engagement mechanism is configured to be positioned within the bore hole and supported at least initially therein by the cover plate that is configured to rest upon the paved surface and substantially cover the bore hole; and wherein, during an engagement procedure, the engagement mechanism is configured to be actuated as by rotation of the screw in a first rotational direction to cause a first movement of the engagement plate so as to shift the engagement member along the sloped wall radially outwardly to move the engagement member into frictional contact with the bore hole to substantially prevent extraction of the engagement mechanism from the bore hole and to substantially prevent lifting of the cover plate due to forces exerted by vehicular traffic thereupon; and further wherein, during a disengagement procedure, the engagement mechanism is configured to be actuated as by rotation of the screw in a second rotational direction opposite the first rotational direction to cause a second movement of the engagement plate so as to shift the engagement member along the sloped wall radially inwardly to allow the engagement member to move out of frictional contact with the bore hole and permit extraction of the engagement mechanism from the bore hole.

19. A selectively frictionally engaged hole cover for covering a bore hole formed through a paved surface, the selectively frictionally engaged hole cover comprising: a cover plate having a top surface and a bottom surface opposite the top surface, the top surface being configured to support safe passage of pedestrians and vehicular traffic across the selectively frictionally engaged hole cover, the cover plate further having a cover plate skirt formed extending downwardly from the bottom surface of the cover plate; and an engagement mechanism coupled with the cover plate and extending from the bottom surface of the cover plate, the engagement mechanism having an engagement plate selectively shiftable relative to the cover plate, the engagement mechanism further having a screw operably installed between the cover plate and the engagement plate, the screw having a head and a shank extending from the head, the shank having a threaded portion formed thereon opposite the head, the engagement plate having a substantially central threaded hole for selective receipt of the threaded portion of the screw, the engagement mechanism further having a retainer plate spaced from the cover plate, wherein a stand-off couples the retainer plate to the cover plate, the stand-off having a through-hole for receipt therethrough of the shank of the screw, the shank having sufficient length to pass out of the through-hole of the stand-off, the engagement mechanism further having a sloped wall extending downwardly and inwardly from the retainer plate, the engagement mechanism further having an engagement member in contact with both the engagement plate and the sloped wall, the engagement plate configured to thereby shift the engagement member along the sloped wall and thus radially outwardly or inwardly as the engagement plate shifts relative to the cover plate; wherein, during an insertion procedure, the engagement mechanism is configured to be positioned within the bore hole and supported at least initially therein by the cover plate that is configured to rest upon the paved surface and substantially cover the bore hole; and wherein, during an engagement procedure, the engagement mechanism is configured to be actuated as by rotation of the screw in a first rotational direction to cause a first movement of the engagement plate so as to shift the engagement member along the sloped wall radially outwardly to move the engagement member into frictional contact with the bore hole to substantially prevent extraction of the engagement mechanism from the bore hole and to substantially prevent lifting of the cover plate due to forces exerted by vehicular traffic thereupon; and further wherein, during a disengagement procedure, the engagement mechanism is configured to be actuated as by rotation of the screw in a second rotational direction opposite the first rotational direction to cause a second movement of the engagement plate so as to shift the engagement member along the sloped wall radially inwardly to allow the engagement member to move out of frictional contact with the bore hole and permit extraction of the engagement mechanism from the bore hole.

In closing, the foregoing descriptions of embodiments of the present invention have been presented for the purposes of illustration and description. It is to be understood that, although aspects of the present invention are highlighted by referring to specific embodiments, one skilled in the art will readily appreciate that these described embodiments are only illustrative of the principles comprising the present invention. As such, the specific embodiments are not intended to be exhaustive or to limit the invention to the precise forms disclosed. Therefore, it should be understood that embodiments of the disclosed subject matter are in no way limited to a particular element, compound, composition, component, article, apparatus, methodology, use, protocol, step, and/or limitation described herein, unless expressly stated as such.

In addition, groupings of alternative embodiments, elements, steps and/or limitations of the present invention are not to be construed as limitations. Each such grouping may be referred to and claimed individually or in any combination with other groupings disclosed herein. It is anticipated that one or more alternative embodiments, elements, steps and/or limitations of a grouping may be included in, or deleted from, the grouping for reasons of convenience and/or patentability. When any such inclusion or deletion occurs, the specification is deemed to contain the grouping as modified, thus fulfilling the written description of all Markush groups used in the appended claims.

Furthermore, those of ordinary skill in the art will recognize that certain changes, modifications, permutations, alterations, additions, subtractions, and sub-combinations thereof can be made in accordance with the teachings herein without departing from the spirit of the present invention. Furthermore, it is intended that the following appended claims and claims hereafter introduced are interpreted to include all such changes, modifications, permutations, alterations, additions, subtractions, and sub-combinations as are within their true spirit and scope. Accordingly, the scope of the present invention is not to be limited to that precisely as shown and described by this specification.

Certain embodiments of the present invention are described herein, including the best mode known to the inventors for carrying out the invention. Of course, variations on these described embodiments will become apparent to those of ordinary skill in the art upon reading the foregoing description. The inventor expects skilled artisans to employ such variations as appropriate, and the inventors intend for the present invention to be practiced otherwise than specifically described herein. Accordingly, this invention includes all modifications and equivalents of the subject matter recited in the claims appended hereto as permitted by applicable law. Moreover, any combination of the above-described embodiments in all possible variations thereof is encompassed by the invention unless otherwise indicated herein or otherwise clearly contradicted by context.

The words, language, and terminology used in this specification is for the purpose of describing particular embodiments, elements, steps and/or limitations only and is not intended to limit the scope of the present invention, which is defined solely by the claims. In addition, such words, language, and terminology are to be understood not only in the sense of their commonly defined meanings, but to include by special definition in this specification structure, material or acts beyond the scope of the commonly defined meanings. Thus, if an element, step, or limitation can be understood in the context of this specification as including more than one meaning, then its use in a claim must be understood as being generic to all possible meanings supported by the specification and by the word itself.

The definitions and meanings of the elements, steps or limitations recited in a claim set forth below are, therefore, defined in this specification to include not only the combination of elements, steps or limitations which are literally set forth, but all equivalent structure, material or acts for performing substantially the same function in substantially the same way to obtain substantially the same result. In this sense it is therefore contemplated that an equivalent substitution of two or more elements, steps or limitations may be made for any one of the elements, steps or limitations in a claim set forth below or that a single element, step, or limitation may be substituted for two or more elements, steps, or limitations in such a claim. Although elements, steps or limitations may be described above as acting in certain combinations and even initially claimed as such, it is to be expressly understood that one or more elements, steps or limitations from a claimed combination can in some cases be excised from the combination and that the claimed combination may be directed to a sub-combination or variation of a sub-combination. As such, notwithstanding the fact that the elements, steps and/or limitations of a claim are set forth below in a certain combination, it must be expressly understood that the invention includes other combinations of fewer, more, or different elements, steps and/or limitations, which are disclosed in above even when not initially claimed in such combinations. Furthermore, insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements. Accordingly, the claims are thus to be understood to include what is specifically illustrated and described above, what is conceptually equivalent, what can be obviously substituted and also what essentially incorporates the essential idea of the invention.

Unless otherwise indicated, all numbers expressing a characteristic, item, quantity, parameter, property, term, and so forth used in the present specification and claims are to be understood as being modified in all instances by the term "about." As used herein, the term "about" means that the characteristic, item, quantity, parameter, property, or term so qualified encompasses a range of plus or minus ten percent above and below the value of the stated characteristic, item, quantity, parameter, property, or term. Accordingly, unless indicated to the contrary, the numerical parameters set forth in the specification and attached claims are approximations that may vary. For instance, as mass spectrometry instruments can vary slightly in determining the mass of a given analyte, the term "about" in the context of the mass of an ion or the mass/charge ratio of an ion refers to +/−0.50 atomic mass unit. At the very least, and not as an attempt to limit the application of the doctrine of equivalents to the scope of the claims, each numerical indication should at least be construed in light of the number of reported significant digits and by applying ordinary rounding techniques.

Notwithstanding that the numerical ranges and values setting forth the broad scope of the invention are approximations, the numerical ranges and values set forth in the specific examples are reported as precisely as possible. Any numerical range or value, however, inherently contains certain errors necessarily resulting from the standard deviation found in their respective testing measurements. Recitation of numerical ranges of values herein is merely intended to serve as a shorthand method of referring individually to each separate numerical value falling within the range. Unless otherwise indicated herein, each individual value of a numerical range is incorporated into the present specification as if it were individually recited herein.

Use of the terms "may" or "can" in reference to an embodiment or aspect of an embodiment also carries with it the alternative meaning of "may not" or "cannot." As such, if the present specification discloses that an embodiment or an aspect of an embodiment may be or can be included as part of the inventive subject matter, then the negative limitation or exclusionary proviso is also explicitly meant, meaning that an embodiment or an aspect of an embodiment may not be or cannot be included as part of the inventive subject matter. In a similar manner, use of the term "optionally" in reference to an embodiment or aspect of an embodiment means that such embodiment or aspect of the embodiment may be included as part of the inventive subject matter or may not be included as part of the inventive subject matter. Whether such a negative limitation or exclusionary proviso applies will be based on whether the negative limitation or exclusionary proviso is recited in the claimed subject matter.

The terms "a," "an," "the" and similar references used in the context of describing the present invention (especially in the context of the following claims) are to be construed to cover both the singular and the plural, unless otherwise indicated herein or clearly contradicted by context. Further, ordinal indicators—such as, e.g., "first," "second," "third," etc.—for identified elements are used to distinguish between the elements, and do not indicate or imply a required or limited number of such elements, and do not indicate a particular position or order of such elements unless otherwise specifically stated. All methods described herein can be performed in any suitable order unless otherwise indicated herein or otherwise clearly contradicted by context. The use of any and all examples or exemplary language (e.g., "such as") provided herein is intended merely to better illuminate the present invention and does not pose a limitation on the scope of the invention otherwise claimed. No language in the present specification should be construed as indicating any non-claimed element essential to the practice of the invention.

When used in the claims, whether as filed or added per amendment, the open-ended transitional term "comprising", variations thereof such as, e.g., "comprise" and "comprises", and equivalent open-ended transitional phrases thereof like "including," "containing" and "having", encompass all the expressly recited elements, limitations, steps, integers, and/or features alone or in combination with unrecited subject matter; the named elements, limitations, steps, integers, and/or features are essential, but other unnamed elements, limitations, steps, integers, and/or features may be added and still form a construct within the scope of the claim. Specific embodiments disclosed herein may be further limited in the claims using the closed-ended transitional phrases "consisting of" or "consisting essentially of" (or variations thereof such as, e.g., "consist of", "consists of", "consist essentially of", and "consists essentially of") in lieu of or as an amendment for "comprising." When used in the claims, whether as filed or added per amendment, the closed-ended transitional phrase "consisting of" excludes any element, limitation, step, integer, or feature not expressly recited in the claims. The closed-ended transitional phrase "consisting essentially of" limits the scope of a claim to the expressly recited elements, limitations, steps, integers, and/or features and any other elements, limitations, steps, integers, and/or features that do not materially affect the basic and novel characteristic(s) of the claimed subject matter. Thus, the meaning of the open-ended transitional phrase "comprising" is being defined as encompassing all the specifically recited elements, limitations, steps and/or features as well as any optional, additional unspecified ones. The meaning of the closed-ended transitional phrase "consisting of" is being defined as only including those elements, limitations, steps, integers, and/or features specifically recited in the claim, whereas the meaning of the closed-ended transitional phrase "consisting essentially of" is being defined as only including those elements, limitations, steps, integers, and/or features specifically recited in the claim and those elements, limitations, steps, integers, and/or features that do not materially affect the basic and novel characteristic(s) of the claimed subject matter. Therefore, the open-ended transitional phrase "comprising" (and equivalent open-ended transitional phrases thereof) includes within its meaning, as a limiting case, claimed subject matter specified by the closed-ended transitional phrases "consisting of" or "consisting essentially of." As such, the embodiments described herein or so claimed with the phrase "comprising" expressly and unambiguously provide description, enablement, and support for the phrases "consisting essentially of" and "consisting of."

Lastly, all patents, patent publications, and other references cited and identified in the present specification are individually and expressly incorporated herein by reference in their entirety for the purpose of describing and disclosing, for example, the compositions and methodologies described in such publications that might be used in connection with the present invention. These publications are provided solely for their disclosure prior to the filing date of the present application. Nothing in this regard is or should be construed as an admission that the inventors are not entitled to antedate such disclosure by virtue of prior invention or for any other reason. All statements as to the date or representation as to the contents of these documents are based on the information available to the applicant and do not constitute any admission as to the correctness of the dates or contents of these documents.

The invention claimed is:

1. A selectively frictionally engaged hole cover for covering a bore hole formed through a paved surface, the selectively frictionally engaged hole cover comprising:

a cover plate having a top surface and a bottom surface opposite the top surface, the top surface being configured to support safe passage of pedestrians and vehicular traffic across the selectively frictionally engaged hole cover; wherein a cover plate skirt is formed extending downwardly from the bottom surface of the cover plate, and an engagement mechanism coupled with the cover plate and extending from the bottom surface of the cover plate, the engagement mechanism having an engagement plate selectively shiftable relative to the cover plate and configured to thereby shift an engagement member along a sloped wall and thus radially outwardly or inwardly, the sloped wall being configured at an angle spanning between the cover plate and the cover plate skirt;

wherein, during an insertion procedure, the engagement mechanism is configured to be positioned within the bore hole and supported at least initially therein by the cover plate that is configured to rest upon the paved surface and substantially cover the bore hole;

and wherein, during an engagement procedure, the engagement mechanism is configured to be actuated to cause a first movement of the engagement plate so as to shift the engagement member along the sloped wall radially outwardly to move the engagement member into frictional contact with the bore hole to substantially prevent extraction of the engagement mechanism from the bore hole and to substantially prevent lifting of the cover plate due to forces exerted by vehicular traffic thereupon.

2. The selectively frictionally engaged hole cover of claim 1, wherein, during a disengagement procedure, the engagement mechanism is configured to be actuated to cause a second movement of the engagement plate so as to shift the engagement member along the sloped wall radially inwardly to allow the engagement member to move out of frictional contact with the bore hole and permit extraction of the engagement mechanism from the bore hole.

3. The selectively frictionally engaged hole cover of claim 2, wherein the engagement mechanism further comprises a screw operably installed between the cover plate and the engagement plate, the screw having a head and a shank extending from the head, the shank having a threaded portion formed thereon opposite the head.

4. The selectively frictionally engaged hole cover of claim 3, wherein actuation of the engagement mechanism comprises rotation of the screw in a first rotational direction to cause the first movement and rotation of the screw in a second rotational direction opposite the first rotational direction to cause the second movement.

5. The selectively frictionally engaged hole cover of claim 4, wherein the cover plate further comprises an access hole, the head of the screw being situated substantially flush or below the top surface of the cover plate and sufficiently aligned with the access hole to permit actuation of the screw through the access hole.

6. The selectively frictionally engaged hole cover of claim 5, wherein the cover plate further comprises an engagement mechanism support bracket having a sidewall extending from the bottom surface of the cover plate about the access hole and further having a support plate coupled with the sidewall opposite of the cover plate, the support plate having a support plate hole sufficiently aligned with the access hole for receipt therethrough of a shank of the screw while the head of the screw seats on the support plate.

7. The selectively frictionally engaged hole cover of claim 6, wherein a stand-off is installed adjacent to the support plate of the engagement mechanism support bracket, the stand-off having a through-hole for receipt therethrough of the shank of the screw, the shank having sufficient length to pass out of the through-hole of the stand-off.

8. The selectively frictionally engaged hole cover of claim 7, wherein a retainer plate is installed adjacent to the stand-off opposite the support plate of the engagement mechanism support bracket, the retainer plate having a retainer plate hole sufficiently aligned with the through-hole of the stand-off for receipt therethrough of the shank of the screw.

9. The selectively frictionally engaged hole cover of claim 8, wherein the sloped wall is installed so as to extend downwardly and inwardly from the retainer plate, whereby the engagement member shifts up and down along the sloped wall and thus radially outwardly and inwardly as the engagement plate shifts up and down relative to the retainer plate.

10. The selectively frictionally engaged hole cover of claim 9, wherein a retainer plate skirt is formed extending downwardly from the retainer plate, and further wherein the sloped wall is configured at an angle spanning between the retainer plate and the retainer plate skirt.

11. The selectively frictionally engaged hole cover of claim 8, wherein the outer edge of the retainer plate and the outer edge of the engagement member are substantially vertically aligned.

12. The selectively frictionally engaged hole cover of claim 3, wherein the engagement plate comprises a substantially central threaded hole for selective receipt of the threaded portion of the screw.

13. The selectively frictionally engaged hole cover of claim 12, wherein the engagement plate further comprises a boss in which the threaded hole is formed.

14. The selectively frictionally engaged hole cover of claim 1, wherein the cover plate skirt and the outer edge of the engagement member are substantially vertically aligned.

15. The selectively frictionally engaged hole cover of claim 1, wherein the engagement plate comprises a perimeter lip oriented to contact the engagement member in shifting the engagement member along the sloped wall as the engagement plate is shifted relative to the cover plate.

16. A selectively frictionally engaged hole cover for covering a bore hole formed through a paved surface, the selectively frictionally engaged hole cover comprising:

a cover plate having a top surface and a bottom surface opposite the top surface, the top surface being configured to support safe passage of pedestrians and vehicular traffic across the selectively frictionally engaged hole cover, the cover plate further having a cover plate skirt formed extending downwardly from the bottom surface of the cover plate; and an engagement mechanism coupled with the cover plate and extending from the bottom surface of the cover plate, the engagement mechanism having an engagement plate selectively shiftable relative to the cover plate, the engagement mechanism further having a screw operably installed between the cover plate and the engagement plate, the screw having a head and a shank extending from the head, the shank having a threaded portion formed thereon opposite the head, the engagement plate having a substantially central threaded hole for selective receipt of the threaded portion of the screw, the engagement mechanism further having a sloped wall configured at an angle spanning between the cover plate and the cover plate skirt, the engagement mechanism further having an engagement member in contact with both the engagement plate and the sloped wall, the engagement plate configured to thereby shift the engagement member along the sloped wall and thus radially outwardly or inwardly as the engagement plate shifts relative to the cover plate;

wherein, during an insertion procedure, the engagement mechanism is configured to be positioned within the bore hole and supported at least initially therein by the cover plate that is configured to rest upon the paved surface and substantially cover the bore hole;

and wherein, during an engagement procedure, the engagement mechanism is configured to be actuated as by rotation of the screw in a first rotational direction to cause a first movement of the engagement plate so as to shift the engagement member along the sloped wall radially outwardly to move the engagement member into frictional contact with the bore hole to substantially prevent extraction of the engagement mechanism from the bore hole and to substantially prevent lifting of the cover plate due to forces exerted by vehicular traffic thereupon;

and further wherein, during a disengagement procedure, the engagement mechanism is configured to be actuated as by rotation of the screw in a second rotational direction opposite the first rotational direction to cause a second movement of the engagement plate so as to shift the engagement member along the sloped wall radially inwardly to allow the engagement member to move out of frictional contact with the bore hole and permit extraction of the engagement mechanism from the bore hole.

17. The selectively frictionally engaged hole cover of claim 16, wherein the cover plate further comprises an access hole, the head of the screw being situated substantially flush or below the top surface of the cover plate and sufficiently aligned with the access hole to permit actuation of the screw through the access hole.

18. The selectively frictionally engaged hole cover of claim 17, wherein the cover plate further comprises an engagement mechanism support bracket having a sidewall extending from the bottom surface of the cover plate about the access hole and further having a support plate coupled with the sidewall opposite of the cover plate, the support plate having a support plate hole sufficiently aligned with the access hole for receipt therethrough of a shank of the screw while the head of the screw seats on the support plate.

19. The selectively frictionally engaged hole cover of claim 18, wherein a stand-off is installed adjacent to the support plate of the engagement mechanism support bracket, the stand-off having a through-hole for receipt therethrough of the shank of the screw, the shank having sufficient length to pass out of the through-hole of the stand-off.

20. The selectively frictionally engaged hole cover of claim 19, wherein a retainer plate is installed adjacent to the stand-off opposite the support plate of the engagement mechanism support bracket, the retainer plate having a retainer plate hole sufficiently aligned with the through-hole of the stand-off for receipt therethrough of the shank of the screw.

21. A selectively frictionally engaged hole cover for covering a bore hole formed through a paved surface, the selectively frictionally engaged hole cover comprising:

a cover plate having a top surface and a bottom surface opposite the top surface, the top surface being configured to support safe passage of pedestrians and vehicular traffic across the selectively frictionally engaged hole cover, the cover plate further having a cover plate skirt formed extending downwardly from the bottom surface of the cover plate; and an engagement mechanism coupled with the cover plate and extending from the bottom surface of the cover plate, the engagement mechanism having an engagement plate selectively shiftable relative to the cover plate, the engagement mechanism further having a screw operably installed between the cover plate and the engagement plate, the screw having a head and a shank extending from the head, the shank having a threaded portion formed thereon opposite the head, the engagement plate having a substantially central threaded hole for selective receipt of the threaded portion of the screw, the engagement mechanism further having a retainer plate spaced from the cover plate, wherein a stand-off couples the retainer plate to the cover plate, the stand-off having a through-hole for receipt therethrough of the shank of the screw, the shank having sufficient length to pass out of the through-hole of the stand-off, the engagement mechanism further having a sloped wall extending downwardly and inwardly from the retainer plate, the engagement mechanism further having an engagement member in contact with both the engagement plate and the sloped wall, the engagement plate configured to thereby shift the engagement member along the sloped wall and thus radially outwardly or inwardly as the engagement plate shifts relative to the cover plate;

wherein, during an insertion procedure, the engagement mechanism is configured to be positioned within the bore hole and supported at least initially therein by the cover plate that is configured to rest upon the paved surface and substantially cover the bore hole;

and wherein, during an engagement procedure, the engagement mechanism is configured to be actuated as by rotation of the screw in a first rotational direction to cause a first movement of the engagement plate so as to shift the engagement member along the sloped wall radially outwardly to move the engagement member into frictional contact with the bore hole to substantially prevent extraction of the engagement mechanism from the bore hole and to substantially prevent lifting of the cover plate due to forces exerted by vehicular traffic thereupon;

and further wherein, during a disengagement procedure, the engagement mechanism is configured to be actuated as by rotation of the screw in a second rotational direction opposite the first rotational direction to cause a second movement of the engagement plate so as to shift the engagement member along the sloped wall radially inwardly to allow the engagement member to move out of frictional contact with the bore hole and permit extraction of the engagement mechanism from the bore hole.

22. The selectively frictionally engaged hole cover of claim 21, wherein the cover plate further comprises an access hole, the head of the screw being situated substantially flush or below the top surface of the cover plate and sufficiently aligned with the access hole to permit actuation of the screw through the access hole.

23. The selectively frictionally engaged hole cover of claim 22, wherein the cover plate further comprises an engagement mechanism support bracket having a sidewall extending from the bottom surface of the cover plate about the access hole and further having a support plate coupled with the sidewall opposite of the cover plate, the support plate having a support plate hole sufficiently aligned with the access hole for receipt therethrough of a shank of the screw while the head of the screw seats on the support plate.

* * * * *